United States Patent [19]

Hinton et al.

[11] Patent Number: 4,488,652

[45] Date of Patent: Dec. 18, 1984

[54] MERCHANDISING DISPLAY CONNECTOR MEANS

[75] Inventors: Teresa L. Hinton, Norcross; William S. Spamer, Roswell, both of Ga.

[73] Assignee: The Mead Corporation, Dayton, Ohio

[21] Appl. No.: 475,048

[22] Filed: Mar. 14, 1983

[51] Int. Cl.[3] ..... A47F 5/00

[52] U.S. Cl. ..... 211/183; 211/149; 211/189; 40/539

[58] Field of Search ..... 211/183, 189, 175, 72, 211/132, 182, 149; 248/174, 223.4; 40/539

[56] References Cited

U.S. PATENT DOCUMENTS

| | | | |
|---|---|---|---|
| 965,658 | 7/1910 | Reubel | 248/223.4 X |
| 2,070,544 | 2/1937 | Clark | 248/174 |
| 2,465,859 | 3/1949 | Fidler | 211/96 X |
| 2,750,050 | 6/1956 | Ebert | 248/174 X |
| 2,987,195 | 6/1961 | Smith | 211/175 |
| 3,533,584 | 10/1970 | Rohrbach | 248/174 |

*Primary Examiner*—Ramon S. Britts
*Assistant Examiner*—Blair M. Johnson
*Attorney, Agent, or Firm*—Rodgers & Rodgers

[57] ABSTRACT

Means is provided for interconnecting a pair of merchandising displays and comprises a pair of uprights, respectively mounted on said displays, each of the uprights comprising a pair of support panels, a pair of slots formed respectively in the upper portions of the inner ones of the support panels, a display bridge interconnecting the uprights and comprising a pair of sign panels, connecting tabs joined respectively to the ends of the sign panels and disposed perpendicular thereto and intermediate the support panels of the associated upright.

3 Claims, 4 Drawing Figures

MERCHANDISING DISPLAY CONNECTOR MEANS

TECHNICAL FIELD

This invention relates to means for interconnecting a pair of vertically disposed merchandising displays in order to increase customer awareness and enhance product appeal.

BACKGROUND ART

Numerous types of merchandising displays are used in the merchandising of various products, such as soft drinks, at the retail level but heretofore means has not been available for effectively interconnecting multiple displays in order to increase the size of the overall display and thereby to attract customer attention.

DISCLOSURE OF THE INVENTION

According to this invention in one form means for interconnecting a pair of merchandising displays is provided and comprises a pair of spaced uprights, each of the uprights including a pair of support panels disposed in substantial face contacting relation, a slot formed in the upper portions of the inner ones of the support panels, a display bridge interconnecting the uprights and comprising at least one sign panel, at least one connecting tab joined to each end edge of the said one side panel and disposed substantially perpendicular to the one sign panel and in flat face contacting relation with the inner surface of the one support panel.

BEST MODE OF CARRYING OUT THE INVENTION

Figure 1:
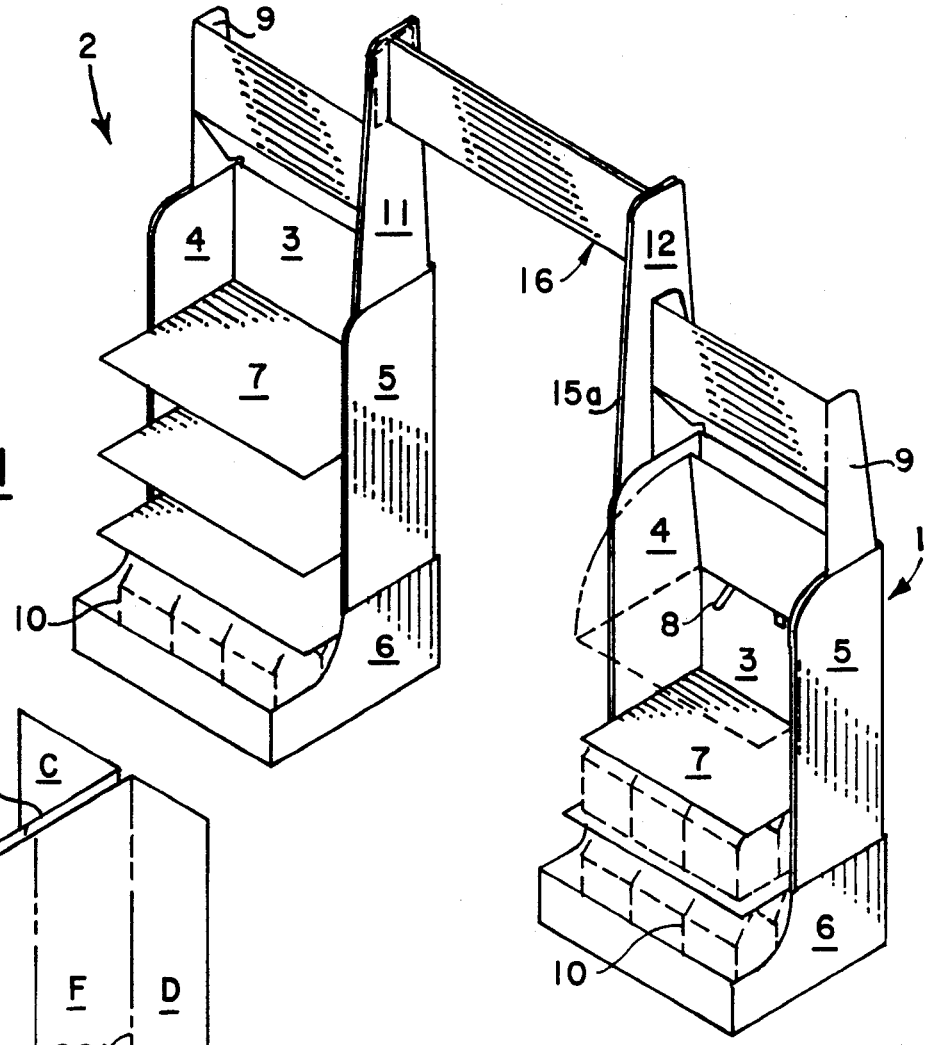
FIG. 1 is a perspective view of a pair of merchandising displays interconnected according to this invention.

In the drawings the numerals 1 and 2 generally designate respectively a pair of one type of vertically disposed merchandising displays. Since the elements of each display are identical, only one will be described in detail. More specifically merchandising display 1 comprises back panel 3 to the side edges of which side panels 4 and 5 are foldably joined. Each of the side panels 4 and 5 comprises a pair of panel elements disposed in flat face contacting relation. For the purpose of stability, back panel 3 and side panels 4 and 5 are securely positioned in base element 6. Shelf 7 is secured along the back portion thereof in one of the slots 8 formed in back panel 3. Finally for the purpose of gaining additional advertising and promotional capability, header board 9 is provided and is disposed between the double panel elements of each side panel 4 and 5.

Of course in actual practice, layers of cartons 10 are positioned in the display as best shown in FIG. 1. As all of the cartons 10 are removed from one of the shelves 7, the shelf is simply folded upwardly to provide easy access to the next lower layer of cartons 10.

Figure 2:
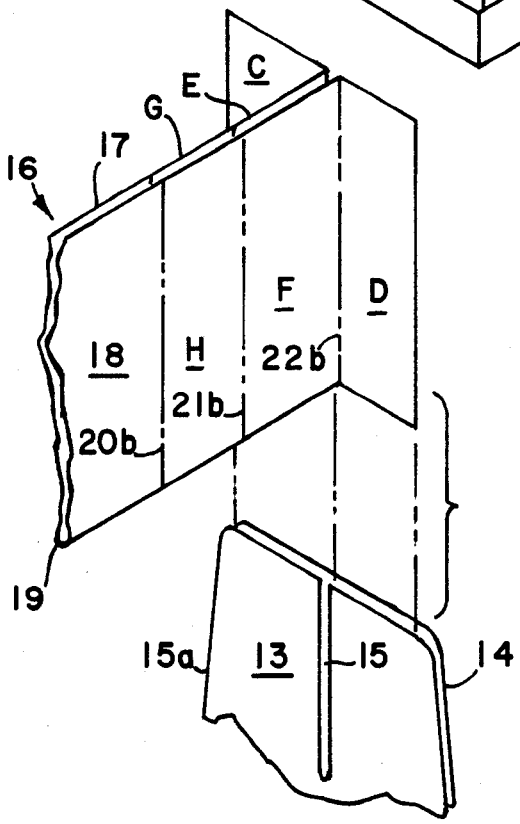
FIG. 2 is an enlarged exploded view showing a portion of the display connector means.

According to this invention in one form, merchandising display connector means is provided as best shown in detail in FIG. 2. More specifically the connector means comprises uprights 11 and 12. Each of the uprights 11 and 12 includes a pair of support panels 13 and 14 which are connected along fold line 15*a*. Also slot 15 is formed in support panel 13.

Figure 3:
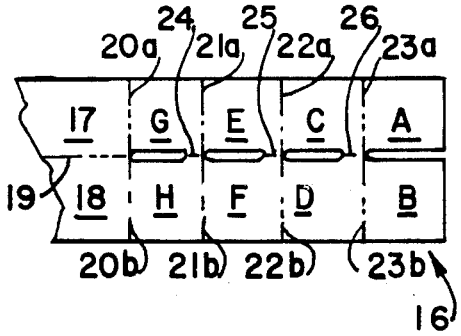
FIG. 3 is a plan view of a portion of the display bridge blank formed according to this invention.

Since aisle widths may vary, it is desirable to provide an aisle bridge whose length is readily adjustable. Thus the display bridge formed according to this invention and identified in the drawings generally by the numeral 16 is shown in blank form in FIGS. 3 and 4. Display bridge 16 comprises sign panels 17 and 18 which are foldably joined along the lower edges thereof by means of fold line 19. As best shown in FIG. 3, multiple connecting tabs A-H are joined to the end edges of the respective sign panel 17 or 18.

More specifically connecting tabs G and H are joined respectively to sign panels 17 and 18 along fold lines 20*a* and 20*b*. Similarly connecting tabs E and F are joined respectively to connecting tabs G and H along fold lines 21*a* and 21*b*. Connecting tabs C and D are joined respectively to connecting tabs E and F along fold lines 22*a* and 22*b* and connecting tabs A and B are joined respectively to connecting tabs C and D along fold lines 23*a* and 23*b*. Also connecting tabs G and H are separated by tear line 24 and, in similar fashion, connecting tabs E and F are separated by fold line 25 and connecting tabs C and D are separated by means of tear line 26.

In order to form the merchandising display connector means according to this invention, initially it is necessary to fold support panels 13 and 14 of each upright 11 and 12 along fold line 15*a* into flat face contacting relation. In addition support panels 13 and 14 can be secured together by any suitable means such as glue. These uprights 11 and 12 are inserted between the dual panels of the associated side panels 4 or 5 of a pair of side by side displays such as are identified by the numerals 1 and 2 in FIG. 1. Following this operation, sign panels 17 and 18 of display bridge 16 are folded along fold line 19 into flat face contacting relation.

Since connecting tabs A-H are each generally three inches wide, merchandising displays 1 and 2 can be separated by means of display bridge 16 at a variety of widths. For example if the maximum separation between merchandising displays 1 and 2 is desired, connecting tabs A and B are folded outwardly of display bridge 16 into positions perpendicular to sign panels 17 and 18. Then display bridge 16 is manuevered to a position in slot 15 whereby connecting tabs A and B are disposed in flat face contacting relation with the inner surface of support panel 13.

Figure 4:
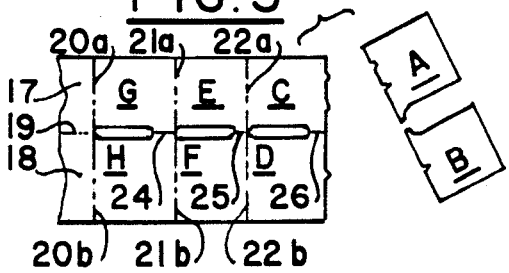
FIG. 4 is a plan view of a portion of the display bridge blank showing the adjustability feature of the invention.

If it is desired that the displays be positioned closer together, connecting tabs A and B or additional connecting tabs, as desired, are simply torn from the adjacent element of display bridge 16 as best shown in FIG. 4. For instance if the displays are to be positioned at the closest possible width, connecting tabs A-F are removed from display bridge 16 by tearing the display bridge blank along fold lines 21*a* and 21*b* and thereby removing connecting tabs A-F. Then connecting tabs G and H are separated by tearing the blank along tear line 24. Following this sign panels 17 and 18 are folded along fold line 19 into face contacting relation and connecting tabs G and H are folded outwardly of display bridge 16 into positions perpendicular thereto. The same procedure is followed at the opposite end of display in connection with the second merchandising display bridge 16 and then the entire unit is positioned in slots 15 of the respective uprights 11 and 12.

INDUSTRIAL APPLICABILITY

Therefore by this invention means is provided to interconnect a pair of merchandising displays at adjustable widths while at the same time increasing customer appeal for the displayed products.

We claim:

1. Merchandising display connector means comprising a pair of spaced uprights, each of said uprights comprising a pair of support panels, a slot formed in the upper portion of each inner one of said support panels, a display bridge interconnecting said two uprights and comprising a pair of sign panels foldably joined together and being disposed in flat face contacting relation to each other, a connecting tab being joined to an end edge of at least one of said sign panels at each end of said display bridge and being disposed substantially perpendicular thereto and intermediate the adjacent ones of said support panels, and each connecting tab being joined to the associated one of said sign panels along a fold line disposed in close proximity to the associated one of said slots.

2. Merchandising display connector means according to claim 1 wherein a connecting tab is joined to each end edge of both of said sign panels and disposed substantially perpendicular thereto, the tabs at each end of said bridge being in alignment with each other.

3. Merchandising display connector means comprising a pair of spaced uprights, each of said uprights comprising a pair of support panels, a slot formed in the upper portion of an inner one of said support panels, a display bridge interconnecting said two uprights and comprising at least one sign panel, a first pair of connecting tabs joined respectively to the ends of said display bridge and being in substantial alignment thereto, a second pair of connecting tabs being detachably joined respectively to said first pair of connecting tabs remote from said display bridge and being disposed substantially perpendicular to said display bridge, and said second pair of connecting tabs being disposed intermediate the adjacent ones of said support panels.

* * * * *